US008087374B2

(12) United States Patent
Porter

(10) Patent No.: US 8,087,374 B2
(45) Date of Patent: Jan. 3, 2012

(54) CABLE-CONCEALING FITTINGS AND FITTING SYSTEM FOR WATERCRAFT

(75) Inventor: Keith H. Porter, Plattsburgh, NY (US)

(73) Assignee: Bruce Vereecken, Akron, OH (US)

( * ) Notice: Subject to any disclaimer, the term of this patent is extended or adjusted under 35 U.S.C. 154(b) by 264 days.

(21) Appl. No.: 12/460,264

(22) Filed: Jul. 16, 2009

(65) Prior Publication Data

US 2011/0011328 A1 Jan. 20, 2011

(51) Int. Cl.
*B63B 17/00* (2006.01)
*B63B 17/02* (2006.01)

(52) U.S. Cl. ..... 114/343; 114/361

(58) Field of Classification Search ..... 403/64, 403/169, 170, 171, 174, 176, 178; 285/125.1, 285/284, 284.1; 138/92, 94, 94.5, 155; 114/361
See application file for complete search history.

(56) References Cited

U.S. PATENT DOCUMENTS

| | | | | |
|---|---|---|---|---|
| 5,170,017 | A | 12/1992 | Stanevich et al. | |
| 6,051,791 | A | 4/2000 | King | |
| 6,923,134 | B1 | 8/2005 | Vrudny et al. | |
| 6,925,948 | B2 | 8/2005 | Nakajima | |
| 7,047,902 | B1 * | 5/2006 | Little | 114/361 |
| 2008/0048438 | A1 * | 2/2008 | Weise et al. | 285/125.1 |

FOREIGN PATENT DOCUMENTS

EP 0 069 576 A1 1/1983

* cited by examiner

*Primary Examiner* — Daniel Venne
*Assistant Examiner* — Anthony Wiest
(74) *Attorney, Agent, or Firm* — Hudak, Shunk & Farine Co. LPA

(57) ABSTRACT

Specialized cable-concealing fittings and couplings suitable and a fitting system for use in forming cable runs comprising tubular framing and rails wherein the fittings, framing and rails can serve a as a conduit for cable. In particular, the cable concealing fittings are utilized in association with a cable from an electrical device such as a solar panel that is connected to an electrical system of a watercraft, such as sailboat or powerboat. The fittings and system utilizing the fittings serves both protective and aesthetic purposes.

18 Claims, 3 Drawing Sheets

CABLE-CONCEALING FITTINGS AND FITTING SYSTEM FOR WATERCRAFT

FIELD OF THE INVENTION

The present invention relates to specialized cable-concealing fittings and couplings and a fitting system suitable for use in forming cable runs comprising tubular framing and rails, wherein the fittings, framing and rails can serve as a conduit for cable. In particular, the cable-concealing fittings are utilized in association with a cable from an electrical device such as a solar panel that is connected to an electrical system of a watercraft, such as a sailboat or powerboat. The fittings and system utilizing the fittings serves both protective and aesthetic purposes.

BACKGROUND OF THE INVENTION

The global trend toward renewable and environmentally clean energy has created an opportunity for the application of solar panels to charge the batteries and augment the electrical power on watercraft, namely sailboats and powerboats. One conventional method of connecting the solar panel to the boat electrical system is to tie-wrap or tape-wrap the solar panel cable to the solar panel frame in one or more places, then to the bimini frame of the boat in several places, then to the stern rail in one or several places, and through a drilled or existing hole in the hull, using a grommet or caulk to hold the cable firmly in the entrance. The cable is then led to the electrical system out of sight beneath the boat enclosure.

The cable and tie-wraps are unsightly and the cable is exposed to the weather and to accidental damage.

Various connector and fitting systems are disclosed in the art.

U.S. Pat. No. 6,925,948 discloses a conduit-supporting structure for a small watercraft that reportedly allows the number of conduit guide components to be reduced, and the required number of processes in piping and wiring to be reduced during assembly. A vessel body includes a hull, constituting the lower portion thereof, and a deck for covering on top of the hull. A floatation insert block is disposed between the hull and the deck, and the block is made with a supporting groove formed therein, for guiding conduit such as a pipe and/or a cable. The conduit is guided along the supporting groove, and is supported in the supporting groove by being pushed therein, taking an advantage of the resiliency of the floatation insert block.

U.S. Pat. No. 6,923,134 discloses a hinge assembly for mounting to a jet propelled personal watercraft including a hinge and a wire bundle assembly. The hinge can include a hinge top portion for mounting to the personal watercraft hood pivotally coupled to a hinge bottom portion for mounting to the top deck. The hinge bottom portion can have a wireway aperture therethrough. The wire bundle assembly can include several wires disposed within a tube, in turn disposed within a seal formed about the tube. The tube seal can be at least partially received within the hinge bottom portion aperture. The tube seal is preferably forced downward by the hinge bottom portion against the top deck. The wire bundle assembly can be formed as an assembly at a site distinct from the site of final watercraft manufacture. The wire bundle assembly can be inserted through the top deck, and secured in place by the hinge being secured to the top deck, over the inserted wire bundle assembly.

U.S. Pat. No. 6,051,791 discloses a waterproof wire connector that has a tubular cap and a tubular shoe which is telescopically received in the cap. An electrical connection is made between the contacting ends of a plurality of electrical wires extending through the shoe and hooked in a slot provided at the forward end of the shoe. As the shoe is inserted into the cap, a sealant in the cap is hydraulically injected around the stripped ends of the wires reportedly electrically insulating and protecting them from oxidation.

U.S. Pat. No. 5,170,017 discloses a connector for passing continuous insulated electrical conductors such as pins or multi-stranded wire through a surface or bulkhead, while reportedly preventing leakage of liquids and gases along the conductors, especially between gaps in the strands. An exemplary connector comprises a body having seal-zone openings in which a sealant is applied and cured around a compressed bared section of multi-stranded wire. The body contains strain relief members adjacent to the sealed openings to provide longitudinal as well as transverse strain relief. A sealant member and radially spaced clasps are located around the sealed openings and strain relief members so that the connector may be removably twist-locked onto a bulkhead reportedly without disturbing the sealed wires.

European Patent No. 0 069 576 discloses a sailboat mast primarily intended for racing which is constructed of three or more vertical columns, two of which can be tubular and the other of which is solid. The columns are arranged in a triangular or diamond pattern and connected by cross braces. The hollow forward tubes are used as conduits for the mainsail halyard and the jumper wires for adjusting or tuning the shape of the mast. If three columns are employed, they are arranged in a triangular pattern with two forward columns forming a leg at right angles with the keel and the aft column on the keel line.

It would be desirable to retrofit existing boats with solar panels utilizing conduit assembles that protect the wiring from the elements and damage, as well as to hide the wiring from view in order to substantially maintain the original aesthetics of the stock craft.

SUMMARY OF THE INVENTION

In view of the above, an object of the present invention is to provide cable-concealing fittings and couplings that allow wiring to pass therethrough.

It is a further object of the present invention to provide fittings and a system comprising the fittings that can be utilized in retrofitting in an existing watercraft or in the wiring of new watercraft that includes a solar panel that is adapted to charge a battery on the boat, wherein the fittings and system protect the solar panel to electrical system cables from the environment and from accidental damage.

Still another object of the present invention is to provide a system that utilizes existing tubular framing in conjunction with fittings of the present invention including cable apertures, such that the existing tubular framing can serve as a conduit for the electrical wiring.

A further object of the present invention is to provide a system that can be retrofitted to existing watercraft on solar panel installations or utilized in new watercraft constructions.

Still a further object of the present invention is to provide specialized fittings for cabling or wiring that allow connection to a portion of a vessel such as a boat and further allow a portion of a wire or cable to extend therethrough.

A further object of the present invention is to provide a fitting including depth limiters that prevents pinching or abrading of cable located within the fitting.

In one aspect of the present invention, a cable-concealing kit is disclosed, comprising: two or more different fittings, said fittings comprising a straight fitting, a slip-fit eye-end fitting, a slip-fit offset swivel end fitting or a T-fitting; the straight fitting comprising a body comprising a pair of tube apertures and a cable aperture located between the tube apertures on the body, the cable aperture being smaller than the tube apertures, and wherein a depth limiter is present on an inner diameter of the body between each tube aperture and the cable aperture; the slip-fit eye-end fitting comprising a body comprising a tube aperture adapted to receive a railing tube, the body further comprising a cable aperture and an offset tab being offset from a central longitudinal axis of the body, wherein the cable aperture is smaller that the tube aperture; the slip-fit offset swivel end fitting comprising a body connected to the base by a swivel fitting, the body further comprising a tube aperture adapted to receive a railing tube and a cable aperture located on the body opposite the tube aperture, and wherein the cable aperture is smaller than the tube aperture; and the T-filling comprising a body including three tube apertures, wherein the T-fitting comprises a depth limiter located on an inside surface of the T-fitting and adjacent each of the tube apertures that are each adapted to limit an insertion depth of a tube therein.

In a further aspect of the present invention, a watercraft having a cable-concealing system is disclosed, comprising a hull and a railing operatively connected to the hull; an electrical device comprising a cable operatively connected to a portion of the watercraft; a cable system comprising a plurality of fittings through which a portion of the cable extends; said fittings comprising two or more different fittings selected from the group consisting of a straight fitting, a slip-fit eye-end fitting, a slip-fit offset swivel end fitting or a T-fitting; the straight fitting comprising a body comprising a pair of tube apertures and a cable aperture located between the tube apertures on the body, the cable aperture being smaller than the tube apertures, and wherein a depth limiter is present on an inner diameter of the body between each tube aperture and the cable aperture; the slip-fit eye-end fitting comprising a body comprising a tube aperture adapted to receive a railing tube, the body further comprising a cable aperture and an offset tab being offset from a central longitudinal axis of the body, wherein the cable aperture is smaller that the tube aperture; the slip-fit offset swivel end fitting comprising a body connected to the base by a swivel fitting, the body further comprising a tube aperture adapted to receive a railing tube and a cable aperture located on the body opposite the tube aperture, and wherein the cable aperture is smaller than the tube aperture; and the T-fitting comprising a body including three tube apertures, wherein the T-fitting comprises a depth limiter located on an inside surface of the T-fitting and adjacent each of the tube apertures that are each adapted to limit an insertion depth of a tube therein, wherein the cable extends through the two or more different fittings present.

In still another aspect of the present invention, a fitting adapted to be used in conjunction with a cable is disclosed, comprising a body having at least two tube apertures and a third aperture, wherein the third aperture is less than or equal to in size compared to the tube apertures, and wherein a depth limiter is present in the body adjacent each tube aperture, the depth limiter having a portion with a radius smaller than an inner radius of the body adjacent the tube apertures.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1A:
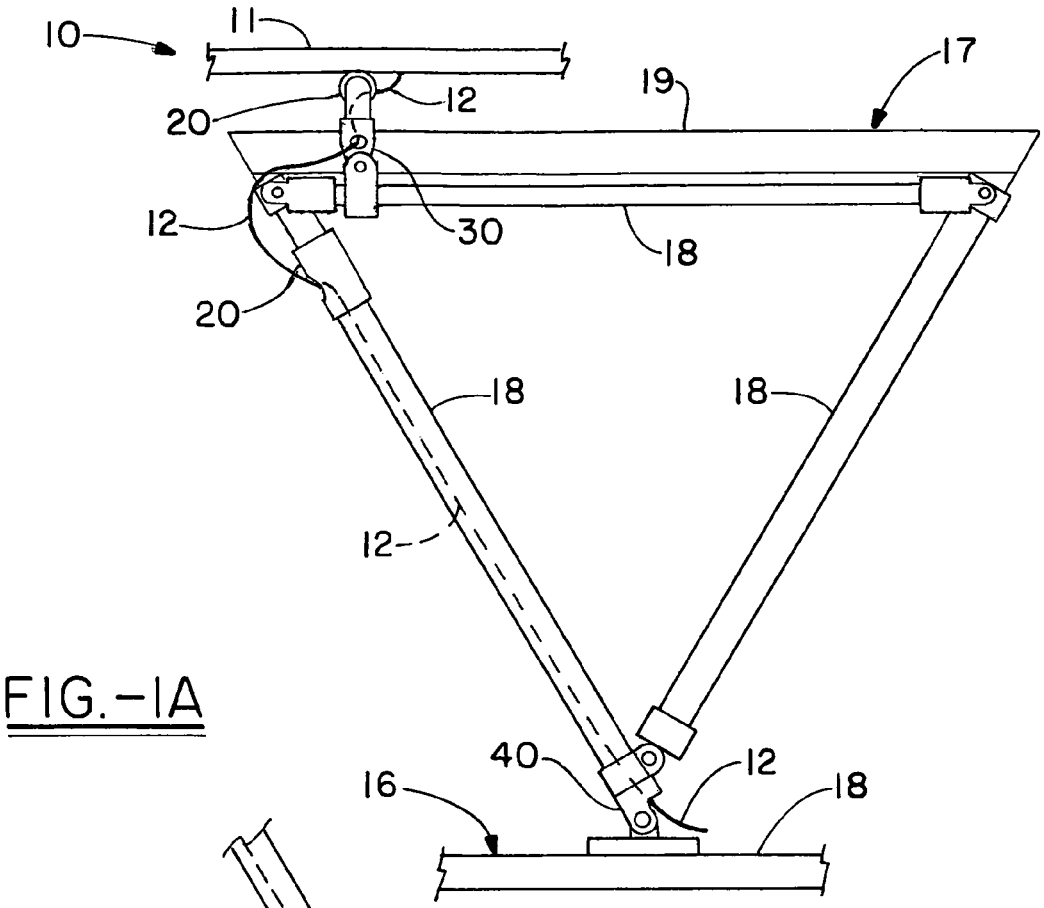
FIG. 1A is a side elevational view of a portion of one embodiment of the present invention illustrating connection of a solar panel to a portion of a bimini top and fittings of the present invention utilized to route electrical wiring extending from the solar panel.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Specialized cable-concealing fittings and systems incorporating the fittings are disclosed that, when utilized with existing structure of a watercraft, such as a sailboat or powerboat, namely tubular framing and rails, serve as a conduit for electrical cables between an electrical device and a portion of an electrical system of the watercraft, such as a battery or battery lead. Examples of electrical devices include, but are not limited too, a solar panel, an antenna, such as a TV antenna, satellite antenna, GPS antenna, radar antenna, and radar arrays.

Figure 1B:
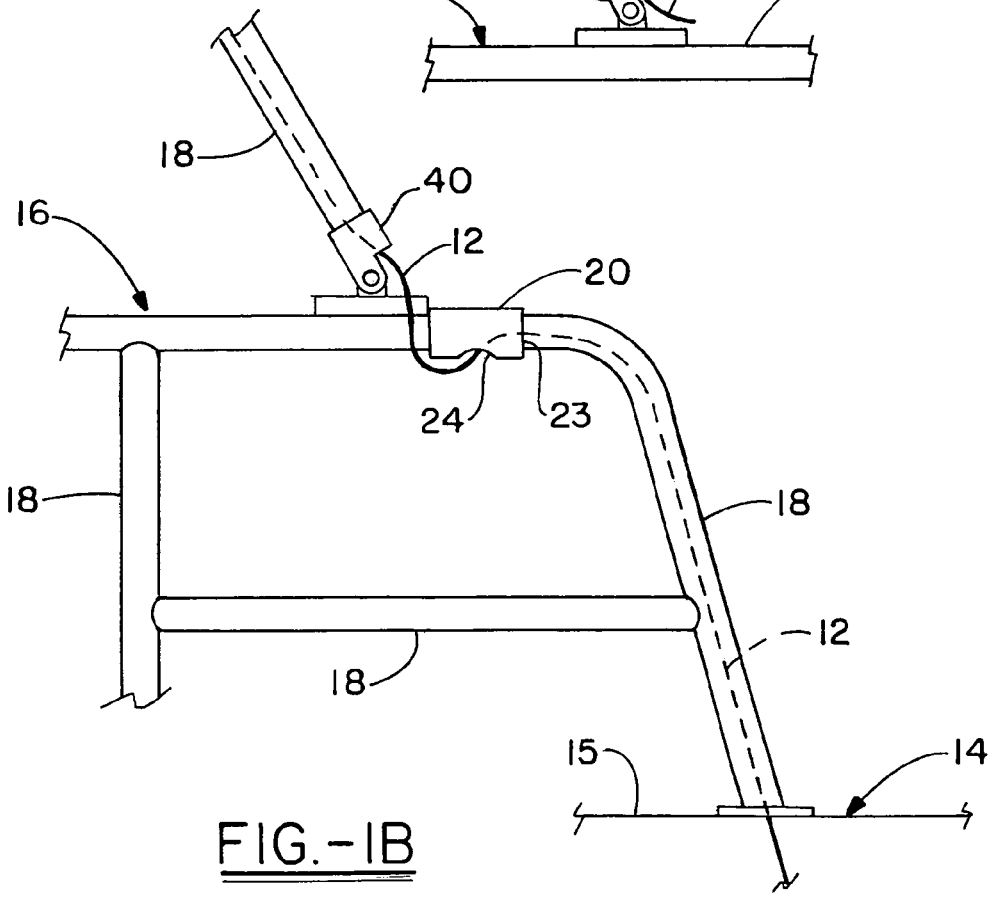
FIG. 1B is a side elevational view of a further portion of the one embodiment particularly illustrating a lower section of the bimini top and stern rail portion of the vessel illustrating additional fittings of the present invention and electrical wiring being routed therethrough.
Figure 3A:
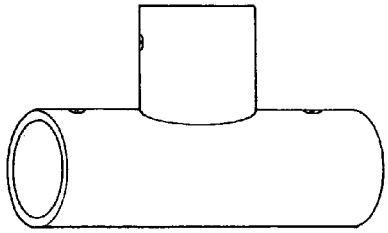
FIG.-3A Prior Art
FIG. 3A is a side perspective view of a conventional prior art bow rail T-90° fitting.

Referring now to the drawings, wherein like numbers represent like or similar structures throughout the several views, FIG. 1A and FIG. 1B show one embodiment of the fitting system for the present invention utilized in conjunction with an electrical device 10 that, in this case, is illustrated as a portion of a solar panel 11. A cable 12 is operatively connected to electrical device 10 at one end and to a portion of the electrical system of the watercraft 14 at a second end (not shown). Cable 12 can generally be any wire or groups of wires, generally containing a conductive core and an outer insulating sheath, for example.

In the embodiment illustrated in FIG. 1A, the electrical device 10 is operatively connected to a portion of a bimini frame 17 comprising tubes 18 and a bimini top 19. Cable 12 from the solar panel 11 is routed through a cable-concealing straight fitting 20, through a cable-concealing slip-fit offset eye-end fitting 30, through a further straight fitting 20, through tube 18 and out through a cable-concealing slip-fit offset swivel end fitting 40 that is attached to railing 16, namely tube 18 thereof.

Figure 2A:
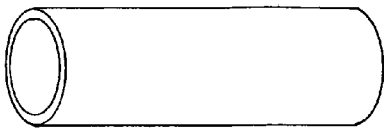
FIG.-2A Prior Art
FIG. 2A is a side perspective view of a conventional prior art straight coupling.
Figure 2B:
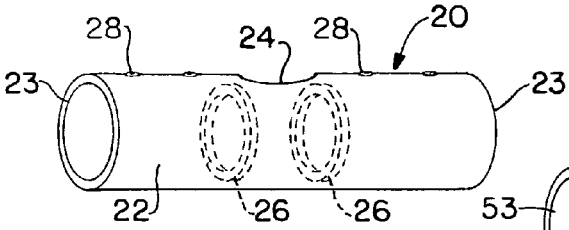
FIG. 2B is a side perspective view of one embodiment of a cable-concealing straight coupling of the present invention showing an cable aperture for a cable and depth limiters located inside the coupling which prevent the tubular framing inserted into the coupling from crimping or abraiding the cable.
Figure 2C:
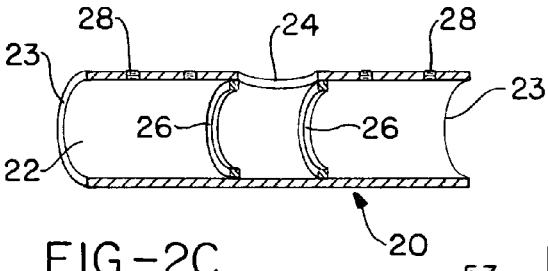
FIG. 2C is a cross-sectional side perspective view of the straight coupling illustrated in FIG. 2B.

Straight fitting 20 is illustrated in FIGS. 2B and 2C. Straight fitting 20 includes a generally cylindrical body 22 having a longitudinal length that generally ranges from about 5 to about 12 centimeters. The longitudinal length of body 22 generally depends upon the application in which the straight fitting 20 is utilized. The inner diameter of body 22 is large enough to accommodate the outer diameter of tube 18. Straight fitting 20 also includes a cable aperture 24 adapted to accept cable 12 such as illustrated in FIG. 1A. The diameter of the cable aperture 24 can vary depending upon the size of the cable utilized and can thus range from about 1 to about 2 centimeters in diameter. Present on each side of cable aperture 24 in a longitudinal direction is a depth limiter 26 that includes at least one portion having an inner diameter less than the inner diameter of the main portion of body 22 in order to prevent a tube 18 from blocking cable aperture 24 or from damaging a cable extending therethrough. Depth limiter 26 can be continuous or discontinuous on the inner surface of body 22 so long as the depth limiter performs its intended purpose. A plurality of set screws 28 can be utilized to secure a tube 18 within straight fitting 20. A tube aperture 23 is located at each end of fitting 20.

In one embodiment, the depth limiter of the present invention 26, 56 can be produced by utilizing a heavier wall thickness in the initial blank and drilling to a desired depth with a diameter that will accommodate the structural tubing 18 being utilized. An alternative embodiment is to provide apertures at an approximate maximum tube depth location wherein the depth limiter such as pan head screws are extended into the inner channel of the desired fitting. Depth fittings are preferably free of sharp edges that could possibly damage the cable insulation.

Figure 5A:
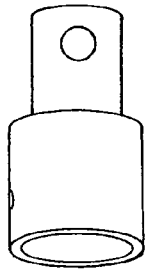
FIG.-5A Prior Art
FIG. 5A is a side perspective view of a conventional prior art slip-fit end fitting.
Figure 5B:
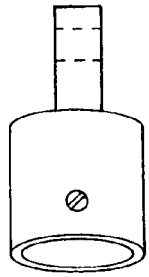
FIG.-5B Prior Art
FIG. 5B is a side perspective view of the embodiment illustrated in FIG. 5A turned at a 90° angle.
Figure 5C:
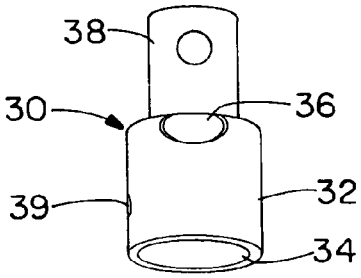
FIG. 5C is a side perspective view of a cable-concealing slip-fit offset eye-end fitting according to one embodiment of the present invention.
Figure 5D:
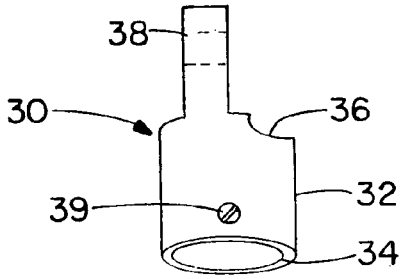
FIG. 5D is a side perspective view of the embodiment illustrated in FIG. 5C turned at a 90° angle.

Offset eye-end fitting 30 is illustrated in one embodiment in FIGS. 5C and 5D. Fitting 30 includes a body 32 having a substantially cylindrical outer surface and inner surface along the longitudinal length thereof. Body 32 includes a tube aperture 34 having an inner diameter sufficient to accept the outer diameter of tube 18. A cable aperture 36 is present on body 32 at an end opposite tube aperture 34. Tube aperture 34 is sized according to the cable utilized, such as described for aperture 34 hereinabove. Cable aperture 36 allows the cable to be routed therethrough and further through the tube aperture 34 and any tube 18 connected thereto. Fitting 30 also includes an offset tab 38 connected to the body opposite tube aperture 34. Tab 38 is also adjacent cable aperture 36 and is preferably located between an outer diameter of the body 32 and a central longitudinal axis of the body. A set screw 39 can be present in order to fixedly connect tube 18 to body 32.

Figure 6A:
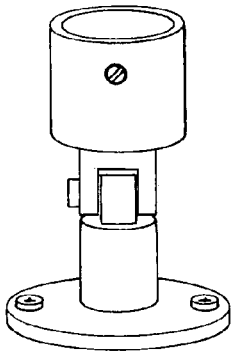
FIG.-6A Prior Art
FIG. 6A is a side perspective view of a conventional prior art swivel-end fitting.
Figure 6B:
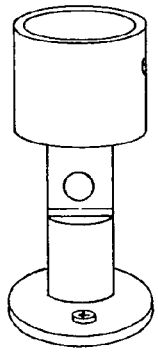
FIG.-6B Prior Art
FIG. 6B is a side perspective view of the embodiment illustrated in FIG. 6A turned at a 90° angle.
Figure 6C:
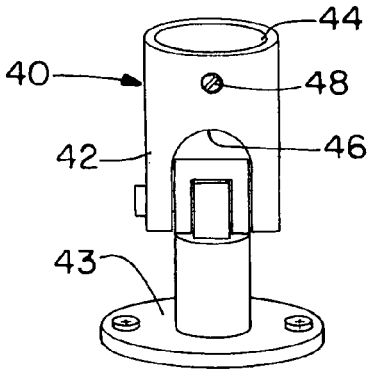
FIG. 6C is a side perspective view of one embodiment of a cable-concealing slip-fit offset swivel-end fitting for a deck mount with a swivel that is offset from center to accommodate the cable aperture.
Figure 6D:
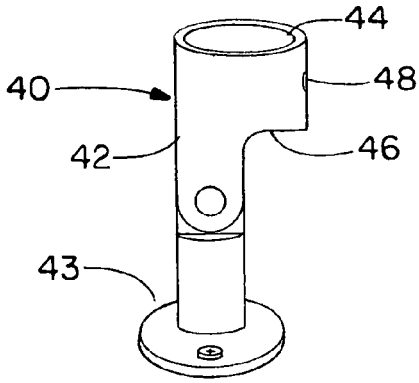
FIG. 6D is a side perspective view of the embodiment illustrated in FIG. 6C turned at a 90° angle.

Slip-fit offset swivel end fitting 40 is illustrated in FIGS. 6C and 6D. Fitting 40 includes a body 42 connected to a base 43 through a suitable fitting such that body 42 is swivelable in relation to base 43 which is generally mounted to a portion of watercraft 14. Body 42 includes a tube aperture 44 sized to accommodate the outer diameter of a tube 18, as described hereinabove. Fitting 40 also includes a cable aperture 46 adapted to receive a cable 12. Cable aperture 46 can be sized as described hereinabove for cable apertures 24 and 36. Cable aperture 46 is generally located on body 42 opposite the tube aperture 44. In one embodiment, the cable aperture is offset from the central longitudinal axis of body 42. A set screw 48 can be present or fixedly connected to tube 18 of body 42.

FIG. 1B illustrates cable 12 from FIG. 1A entering a cable-concealing straight fitting 20 connected to railing 16 of watercraft 14. Cable 20 passes through cable aperture 24 of fitting 20 and out through tube aperture 23 and into tube 18 that is inserted into body 22 of straight fitting 20. The cable then passes through the other end of tube 18 into the hull 15 of watercraft 14.

Figure 3B:
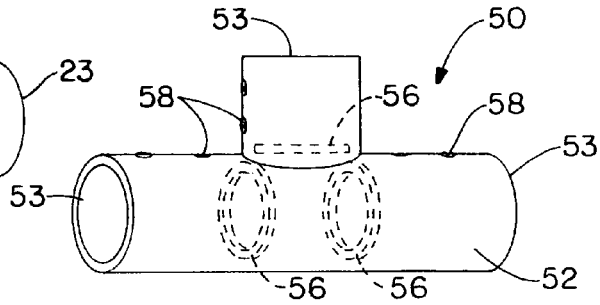
FIG. 3B is a side perspective view of one embodiment of a cable-concealing bow rail T-90° fitting of the present invention, particularly illustrating depth limiters.
Figure 3C:
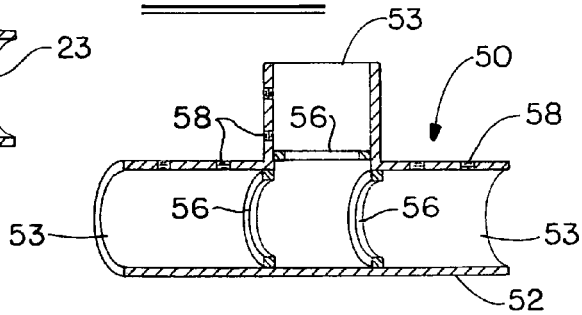
FIG. 3C cross-sectional side perspective view of one embodiment of the cable-concealing bow rail T-90° fitting illustrated in FIG. 3B.
Figure 4A:
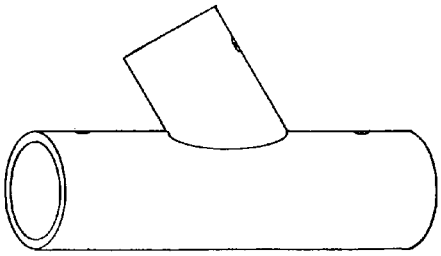
FIG.-4A Prior Art
FIG. 4A is a side perspective view of a conventional prior art bow railing T-60° fitting.
Figure 4B:
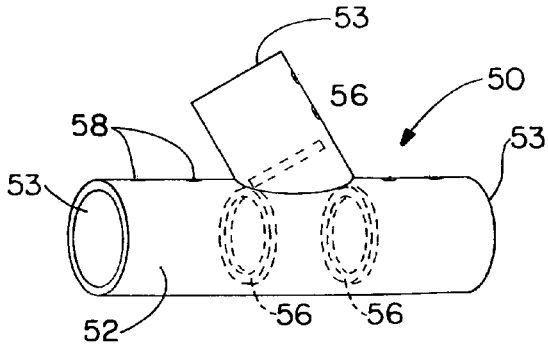
FIG. 4B is a side perspective view of one embodiment of a cable concealing bow rail T-60° fitting of the present invention, particularly illustrating depth limiters.

In a further embodiment of the present invention, a T-shaped fitting 50 is provided, see FIGS. 3B, 3C and 4B. T-fittings 50 include a body 52 and three tube apertures 53, wherein one of the apertures 53 is disposed at an angle in relation to the main longitudinal axis extending through body 52. The angle ranges generally from about 45° to about 90°, with angles of about 60° and 90° being preferred. T-fitting 50 includes the plurality depth limiters 56 located inside the fitting 50 to prevent a tube 18 from impinging on cable 12. Preferably, a depth limiter is present in each section of the T-fitting 50 that includes a tube aperture 53. The cable 12 can be routed through two or more of the tube apertures 53. The presence of the depth limiters 56 prevents two tubes inserted into T-fitting 50 from contacting each other and thus possibly interfering with cable 12. T-fitting 50 also includes set screws 58 or other fasteners adapted to maintain a secure fitting between a tube 18 and T-fitting 50.

The cable-concealing fittings and couplings of the present invention can be made of generally any material such as metal or polymer. In one embodiment, the fittings are stainless steel, as are most typical standard fittings and couplings. Alternatives further include aluminum, chrome-plated steel, and other metals.

As indicated hereinabove, the diameter of the cable apertures can vary and in one embodiment are about 1.27 centimeters. Cable apertures can accommodate either a single cable with two conductors or two or more single insulated cables or wires. Small apertures can make problematic the passage of the cable or wires. Larger apertures can jeopardize the integrity of the fitting. Typically, grommets or caulk are not used in the cable connecting fittings or couplings since a water-tight seal is not necessary, but can be utilized if desired.

Most of the applications for cable-concealing fittings and couplings are for 2.54 centimeters (one inch) diameter stainless steel tubing. In certain cases, for example a solar panel frame consisting of 2.54 centimeters (one inch) diameter tubing may be mounted (connected) to a bimini frame of 3.175 centimeters (one and one quarter inch) diameter tubing. Hence, the two most commonly used sizes of fittings would be 2.54 centimeters (one inch) and 3.175 centimeters (one and one quarter inch) diameter.

In view of the above, it is understood that a cable-concealing kit for a watercraft is provided. The kit comprises at least two, or even three or more, or four or more, fittings of the present invention, for example a straight fitting 20 including a cable aperture and depth limiter, a slip-fit offset eye-end fitting including a cable aperture, a slip-fit offset swivel end fitting comprising a tube aperture, or a T-fitting including depth limiters, or any combination thereof. The kit is utilized in association with the existing hull and railing of the watercraft, or in some embodiments, is also provided with one or more tubes, railings or other fittings that can be used in conjunction with a particular watercraft.

In accordance with the patent statutes, the best mode and preferred embodiment have been set forth, the scope of the invention is not limited thereto, but rather by the scope of the attached claims.

What is claimed is:

1. A cable-concealing kit, comprising:

two or more different fittings, said fittings comprising a straight fitting, a slip-fit eye-end fitting, a slip-fit offset swivel end fitting or a T-fitting, wherein at least one fitting is a slip-fit eye-end fitting;

the straight fitting comprising a body comprising a pair of tube apertures and a cable aperture located between the tube apertures on the body, the cable aperture being smaller than the tube apertures, and wherein a depth limiter is present on an inner diameter of the body between each tube aperture and the cable aperture;

the slip-fit eye-end fitting comprising a body comprising a tube aperture adapted to receive a railing tube, the body further comprising a cable aperture and an offset tab being offset from a central longitudinal axis of the body, wherein the cable aperture is smaller that the tube aperture, wherein the offset tab is present on the body opposite the tube aperture and offset from the longitudinal axis of the body, and wherein the offset tab includes a tab aperture;

the slip-fit offset swivel end fitting comprising a body connected to the base by a swivel fitting, the body further comprising a tube aperture adapted to receive a railing tube and a cable aperture located on the body opposite the tube aperture, and wherein the cable aperture is smaller than the tube aperture; and the T-fitting comprising a body including three tube apertures, wherein the T-fitting comprises a depth limiter located on an inside surface of the T-fitting and adjacent each of the tube apertures that are each adapted to limit an insertion depth of a tube therein.

2. The cable-concealing kit according to claim 1, wherein at least one straight fitting is present, and wherein the straight fitting depth limiters each have an inner diameter that is smaller than an inner diameter of the straight fitting body.

3. The cable-concealing kit according to claim 1, wherein at least one fitting is the T-fitting, wherein the T-fitting body comprises a longitudinal axis, wherein one of the tube apertures has a central axis located at an angle from about 60° to about 90° compared to the longitudinal axis, and wherein each T-fitting depth limiter has a portion with an inner radius that is less than an inner radius of the body.

4. The cable-concealing kit according to claim 1, wherein at least one slip-fit offset swivel end fitting is present, wherein the cable aperture is present on the slip-fit offset swivel end body opposite the tube aperture, and wherein the body is connected to the base via a tab that is offset from a central longitudinal axis of the slip-fit offset swivel end body.

5. The cable-concealing kit according to claim 1, wherein at least one straight fitting is present, and wherein the straight fitting depth limiters each have an inner diameter that is smaller than an inner diameter of the straight fitting body.

6. The cable-concealing kit according to claim 1, wherein at least one fitting is the T-fitting, wherein the T-fitting body comprises a longitudinal axis, wherein one of the tube apertures has a central axis located at an angle from about 60° to about 90° compared to the longitudinal axis, wherein each T-fitting depth limiter has a portion with an inner radius that is less than an inner radius of the body, wherein at least one slip-fit offset swivel end fitting is present, wherein the cable aperture is present on the slip-fit offset swivel end body opposite the tube aperture, and wherein the body is connected to the base via a tab that is offset from a central longitudinal axis of the slip-fit offset swivel end body.

7. A watercraft having a cable-concealing system, comprising:

a hull and a railing operatively connected to the hull;

an electrical device comprising a cable operatively connected to a portion of the watercraft;

a cable system comprising a plurality of fittings through which a portion of the cable extends; said fittings comprising two or more different fittings selected from the group consisting of a straight fitting, a slip-fit eye-end fitting, a slip-fit offset swivel end fitting and a T-fitting, wherein at least one fitting is a slip-fit eye-end fitting;

the straight fitting comprising a body comprising a pair of tube apertures and a cable aperture located between the tube apertures on the body, the cable aperture being smaller than the tube apertures, and wherein a depth limiter is present on an inner diameter of the body between each tube aperture and the cable aperture;

the slip-fit eye-end fitting comprising a body comprising a tube aperture adapted to receive a railing tube, the body further comprising a cable aperture and an offset tab being offset from a central longitudinal axis of the body, wherein the cable aperture is smaller that the tube aperture, wherein the offset tab is present on the body opposite the tube aperture and offset from the longitudinal axis of the body, and wherein the offset tab includes a tab aperture;

the slip-fit offset swivel end fitting comprising a body connected to the base by a swivel fitting, the body further comprising a tube aperture adapted to receive a railing tube and a cable aperture located on the body opposite the tube aperture, and wherein the cable aperture is smaller than the tube aperture; and the T-fitting comprising a body including three tube apertures, wherein the T-fitting comprises a depth limiter located on an inside surface of the T-fitting and adjacent each of the tube apertures that are each adapted to limit an insertion depth of a tube therein, and wherein the cable extends through the two or more different fittings present.

8. The system according to claim 7, wherein at least one straight fitting is present, and wherein the straight fitting depth limiters each have an inner diameter that is smaller than an inner diameter of the straight fitting body.

9. The system according to claim 7, wherein at least one fitting is the T-fitting, wherein the T-fitting body comprises a longitudinal axis, wherein one of the tube apertures has a central axis located at an angle from about 60° to about 90° compared to the longitudinal axis, and wherein each T-fitting depth limiter has a portion with an inner radius that is less than an inner radius of the body.

10. The system according to claim 7, wherein at least one slip-fit offset swivel end fitting is present, wherein the cable aperture is present on the slip-fit offset swivel end body opposite the tube aperture, and wherein the body is connected to the base via a tab that is offset from a central longitudinal axis of the slip-fit offset swivel end body.

11. The system according to claim 7, wherein at least one straight fitting is present, wherein the straight fitting depth limiters each have an inner diameter that is smaller than an inner diameter of the straight fitting body, wherein at least one fitting is a slip-fit eye-end fitting, wherein the offset tab is present on the body opposite the tube aperture and offset from the longitudinal axis of the body, and wherein the offset tab includes a tab aperture.

12. The system according to claim 7, wherein at least one fitting is the T-fitting, wherein the T-fitting body comprises a longitudinal axis, wherein one of the tube apertures has a central axis located at an angle from about 60° to about 90° compared to the longitudinal axis, wherein each T-fitting depth limiter has a portion with an inner radius that is less than an inner radius of the body, wherein at least one slip-fit offset swivel end fitting is present, wherein the cable aperture is present on the slip-fit offset swivel end body opposite the tube aperture, and wherein the body is connected to the base via a tab that is offset from a central longitudinal axis of the slip-fit offset swivel end body.

13. A cable-concealing kit, comprising:

two or more different fittings, said fittings comprising a straight fitting, a slip-fit eye-end fitting, a slip-fit offset swivel end fitting or a T-fitting, wherein at least one slip-fit offset swivel end fitting is present;

the straight fitting comprising a body comprising a pair of tube apertures and a cable aperture located between the tube apertures on the body, the cable aperture being smaller than the tube apertures, and wherein a depth limiter is present on an inner diameter of the body between each tube aperture and the cable aperture;

the slip-fit eye-end fitting comprising a body comprising a tube aperture adapted to receive a railing tube, the body further comprising a cable aperture and an offset tab being offset from a central longitudinal axis of the body, wherein the cable aperture is smaller that the tube aperture;

the slip-fit offset swivel end fitting comprising a body connected to the base by a swivel fitting, the body further comprising a tube aperture adapted to receive a railing tube and a cable aperture located on the body opposite the tube aperture, and wherein the cable aperture is smaller than the tube aperture, wherein the cable aperture is present on the slip-fit offset swivel end body opposite the tube aperture, and wherein the body is connected to the base via a tab that is offset from a central longitudinal axis of the slip-fit offset swivel end body; and the T-fitting comprising a body including three tube apertures, wherein the T-fitting comprises a depth limiter located on an inside surface of the T-fitting and adjacent each of the tube apertures that are each adapted to limit an insertion depth of a tube therein.

14. The cable-concealing kit according to claim 13, wherein at least one straight fitting is present, and wherein the straight fitting depth limiters each have an inner diameter that is smaller than an inner diameter of the straight fitting body.

15. The cable-concealing kit according to claim 13, wherein at least one fitting is a slip-fit eye-end fitting, wherein the offset tab is present on the body opposite the tube aperture and offset from the longitudinal axis of the body, and wherein the offset tab includes a tab aperture.

16. The cable-concealing kit according to claim 13, wherein at least one fitting is the T-fitting, wherein the T-fitting body comprises a longitudinal axis, wherein one of the tube apertures has a central axis located at an angle from about 60° to about 90° compared to the longitudinal axis, and wherein each T-fitting depth limiter has a portion with an inner radius that is less than an inner radius of the body.

17. The cable-concealing kit according to claim 13, wherein at least one straight fitting is present, wherein the straight fitting depth limiters each have an inner diameter that is smaller than an inner diameter of the straight fitting body, wherein at least one fitting is a slip-fit eye-end fitting, wherein the offset tab is present on the body opposite the tube aperture and offset from the longitudinal axis of the body, and wherein the offset tab includes a tab aperture.

18. The cable-concealing kit according to claim 13, wherein at least one fitting is the T-fitting, wherein the T-fitting body comprises a longitudinal axis, wherein one of the tube apertures has a central axis located at an angle from about 60° to about 90° compared to the longitudinal axis, wherein each T-fitting depth limiter has a portion with an inner radius that is less than an inner radius of the body.

* * * * *